US005352372A

United States Patent [19]

North

[11] Patent Number: 5,352,372

[45] Date of Patent: Oct. 4, 1994

[54] TEXTILE RESINS WITH REDUCED FREE FORMALDEHYDE

[75] Inventor: Bernard F. North, Rock Hill, S.C.

[73] Assignee: Sequa Chemicals, Inc., Chester, S.C.

[21] Appl. No.: 12,229

[22] Filed: Feb. 2, 1993

[51] Int. Cl.[5] ..... D06M 13/402

[52] U.S. Cl. ..... 252/8.6; 252/8.9; 8/127.6; 8/115.65; 8/195; 8/120

[58] Field of Search ..... 252/8.6, 8.9; 8/127.6, 8/115.65, 195, 194, 120

[56] References Cited

U.S. PATENT DOCUMENTS

| | | | |
|---|---|---|---|
| 4,396,391 | 8/1984 | North | 8/181 |
| 4,488,878 | 12/1984 | Andrews et al. | 8/187 |
| 4,539,008 | 9/1985 | Andrews et al. | 8/187 |
| 5,112,652 | 5/1992 | Greene | 427/342 |
| 5,160,503 | 11/1992 | Smith | 8/115.7 |

*Primary Examiner*—Paul Lieberman
*Assistant Examiner*—Michael P. Tierney
*Attorney, Agent, or Firm*—Mitchell D. Bittman

[57] ABSTRACT

A composition is provided for treating textile fabrics which reduces or eliminates free formaldehyde in the resin and the treated fabric while providing a non-yellowing treated fabric comprising DMDHEU or alkylated DMDHEU and dimethyl acetoacetamide.

11 Claims, No Drawings

TEXTILE RESINS WITH REDUCED FREE FORMALDEHYDE

BACKGROUND

The use of dimethyloldihydroxyethylene urea (DMDHEU) in the preparation of durable press finished fabrics has been well known in the textile industry. However, associated with the use of DMDHEU resins is the release of free formaldehyde both in the resin and on the fabric. The release of free formaldehyde is generally undesirable as it is considered to be an irritant and there is a desire to thus reduce or eliminate the free formaldehyde.

Various formaldehyde scavengers have been developed in the textile industry including the use of urea, nitrogen containing aromatic heterocyclics and non-aromatic alcohols.

U.S. Pat. No. 5,112,652 discloses that acetoacetamide and to a less extent its derivatives serve as formaldehyde scavengers in reducing free formaldehyde from certain cellulosic based products. Specifically acetoacetamide is disclosed as a formaldehyde scavenger in durable press finished fabrics finished with methylol resins such as DMDHEU. However, acetoacetamide has been found to impart a unacceptable yellowing to the treated fabrics.

SUMMARY

Briefly, this invention provides a composition for treating textile fabrics which significantly reduces or eliminates free formaldehyde while providing a non-yellowing treated fabric comprising a resin containing DMDHEU or an alkylated DMDHEU mixed with dimethyl acetoacetamide. Preferably the composition additionally contains a polyol which may be either reacted with the DMDHEU or blended into the composition.

DETAILED DESCRIPTION

Dimethyloldihydroxyethylene urea (DMDHEU) or alkylated DMDHEU is used in preparing durable press finishes. The use of dimethyl acetoacetamide has been found to reduce free formaldehyde levels both in the DMDHEU resin and in the finished treated fabric.

Generally, the level of use of the dimethyl acetoacetamide is within the range of 2 to 60%, preferably 5 to 40% by weight of the DMDHEU. At this level of use reductions of free formaldehyde of at least 25%, preferably 95% in the resin and at least 25%, preferably 95% in the treated fabric can be achieved. In optimal cases free formaldehyde in the resin and in the fabric has been eliminated, i.e. reduced below the measurable limit. Surprisingly the use of dimethyl acetoacetamide has been found effective in reducing or eliminating free formaldehyde, while not imparting undesirable characteristics such as yellowing to the treated fabric. In preparing the composition by mixing the dimethyl acetoacetamide with the DMDHEU or alkylated DMDHEU, sufficient time is provided for the free formaldehyde to be reacted. This results in a composition with extremely low levels of residual formaldehyde which benefits the manufacturing environment when the composition is being applied to the fabric. Also the treated fabric has extremely low or even essentially no residual formaldehyde as measured by the AATCC test method 118.

The admixture of polyols to either DMDHEU or to the finishing bath gives little or no reduction in free formaldehyde in the resin, but will reduce the residual formaldehyde on the treated fabric. Similarly as taught in U.S. Pat. No. 4,396,391, which is hereby incorporated herein by reference, the reaction of polyols with DMDHEU or alkylated DMDHEU gives even lower residual formaldehyde on the fabric. Although the use of dimethyl acetoacetamide gives reductions in formaldehyde levels with DMDHEU alone or with DMDHEU mixed with polyols, it is beneficial to use DMDHEU reacted with polyols which provides the lowest overall levels of residual formaldehyde. The by weight ratio of amount of DMDHEU: polyol is generally in a ratio of from 1-0.2:1-6, preferably 1-05:1-3.0. The preferred polyols are ethylene glycol, diethylene glycol, propylene glycols, butylene glycols and their mixtures.

The reaction of polyol with DMDHEU or alkylated DMDHEU may be carried out in aqueous solution within the temperature range of about 10° to 100° C., and preferably within the range of about 50° to 80° C. for about 1 to 18 hours, and preferably for about 2 to 6 hours. The pH of the composition may range from about 1.0 to 6.0, and preferably it is within the range of about 2.0 to 4.0. The pH may be adjusted with any suitable and convenient acid, such as for example sulfuric acid, nitric acid, phosphoric acid, hydrochloric acid; and organic acid such as citric acid; or the like; or their mixtures.

The composition may be used to treat fabrics by mixing with a catalyst then applying it to the fabric by padding, foaming or by any other suitable technique including low wet pick-up procedures such as vacuum extraction to the fabric. Suitable catalysts include magnesium chloride, either used alone or activated by the addition of an organic acid or an aluminum salt, magnesium nitrate, aluminum chloride, aluminum sulfate, zinc chloride, zinc nitrate, zinc fluoborate, phosphoric acid or any other known to the art. The catalysts are generally added in amounts from 5 to 50% by weight of the reactant (i.e. the DMDHEU).

The composition will generally be applied from an aqueous or alcoholic solution. The solvent may be water; an aliphatic alcohol, e.g., methanol, ethanol, or isopropanol; or a mixture of water and an aliphatic alcohol. Other conventional additives such as lubricants, softeners, bodying agents, water repellents, flame retardants, soil shedding agents, mildew inhibitors, anti-wet soiling agents, fluorescent brighteners, and the like may be used in the treating bath in conventional amounts. Such auxiliaries must not, however, interfere with the proper functioning of the finishing compositions, must not themselves have a deleterious effect on the fabric, and desirably are free of formaldehyde.

The amount of the composition which is applied to the fabric will depend upon the type of fabric and its intended application. In general it is about 0.5 to 10 percent, and preferably about 2 to 5 percent, based on the weight of the fabric.

In the process of treating fabrics with the composition of this invention, the fabric is impregnated with an aqueous or alcoholic solution of the finishing resin, and the impregnated fabric is then dried and cured; the drying and curing steps may be consecutive or simultaneous.

If desired, the textile fabric may be finished by post-curing (also known as deferred or delayed curing). This consists of impregnating the fabric with a solution of the finishing resins and catalyst, drying the impregnated material carefully so that the finishing agent does not react, and then, after a prolonged interval, heating the material to a temperature at which the agent reacts under the influence of the catalyst.

Drying is usually carried out at temperatures of from about 180° to 300° F. and curing at temperatures from about 280° to 425° F.

Beneficially the composition of this invention provides a textile durable press resin with very low free formaldehyde and also a durable press finished fabric with free formaldehyde substantially reduced or eliminated, but in which the treated fabric maintains its whiteness (i.e. does not yellow).

In the examples the following test methods as defined are referred to:

| TEST METHODS: | |
|---|---|
| Whiteness | ASTM Standard Test Method No. E313 "Indexes Of Whiteness and Yellowness Of Near-White, Opaque Materials" |
| WRA | AATCC Test Method 66-1990 "Wrinkle Recovery Of Fabrics: Recovery Angle Method" |
| Fabric Smoothness | AATCC Test Method 124-1989 "Appearance Of Fabrics After Repeated Home Laundering" |
| Lightfastness | AATCC Test Method 16-1990 "Colorfastness To Light" |

EXAMPLE I

A control resin was made by mixing 2250 parts of a 54% aqueous solution of dimethylol dihydroxy ethylene urea (DMDHEU) with 600 parts of diethylene glycol. The pH was adjusted to 3.0 by using 32 parts of 40% aqueous sulfuric acid and the temperature raised to 70° C. and held for four hours. The reaction product was then cooled and the pH was adjusted to 4.0 by using 29 parts of 25% caustic soda. Thus was obtained a 60% aqueous solution of a glycol capped DMDHEU (Sample A).

Test results were prepared by mixing the following:

| | |
|---|---|
| 1. | |
| Sample A | 325 parts |
| water | 175 parts |
| 2. | |
| Sample A | 325 parts |
| acetoacetamide (30%) | 125 parts |
| water | 50 parts |
| 3. | |
| Sample A | 325 parts |
| monomethyl acetoacetamide (70%) | 50 parts |
| water | 125 parts |
| 4. | |
| Sample A | 325 parts |
| dimethyl acetoacetamide (80%) | 50 parts |
| water | 125 parts |

The storage stability of all the above samples was considered excellent except that Sample 3 deposited a large number of needle like crystals after about two weeks when held at room temperature.

Broadcloth (100% cotton) was impregnated through a pad bath using two nips and two dips to achieve a wet pick-up of approximately 65%. Fabrics were then dried by heating for four minutes at 225° F. and then cured by heating for ninety seconds at 340° F. Catalyst 531 is a citric acid activated magnesium chloride catalyst sold by Sequa Chemicals Inc. and Sulfanole 634 is a nonionic wetting agent sold by Sequa Chemicals Inc.

| | PAD BATH | | | | |
|---|---|---|---|---|---|
| | 1 | 2 | 3 | 4 | 5 |
| Resin 1 | 10% | | | | |
| Resin 2 | | 10% | | | |
| Resin 3 | | | 10% | | |
| Resin 4 | | | | 10% | |
| Catalyst 531 | 2.5% | 2.5% | 2.5% | 2.5% | |
| Sulfanole ® 634 | .25% | .25% | .25% | .25% | .25% |
| FABRIC PROPERTIES: | | | | | |
| Wrinkle Recovery Angle (warp + fill) | 257 | 257 | 254 | 255 | 201 |
| Wrinkle Recovery Angle (warp + fill after 5 home launderings) | 253 | 254 | 252 | 246 | 189 |
| Tensile Strength (warp) | 35 | 38 | 37 | 41 | 83 |
| Whiteness | good | poor | fair | good | good |
| Lightfastness (blue test fabric) | 3.5 | 3.0 | 3.0 | 3.5 | 3.5 |
| Free formaldehyde | .5% | <.1% | <.1% | <.1% | |
| Formaldehyde on fabric (dried only) (p.p.m.) | 120 | 10 | 10 | 30 | 0 |
| Formaldehyde on fabric (cured) (p.p.m.) | 40 | 0 | 0 | 10 | 0 |

These test results show the reduction of free formaldehyde in the resin as well as the treated fabric, with the resin containing dimethyl acetoacetamide additionally demonstrating good whiteness compared to substantial yellowing for the fabric treated with resin containing acetoacetamide.

In addition, the blue test fabric shows no loss of lightfastness when treated with the resin containing dimethyl acetoacetamide, whereas the same fabric treated with resins containing either acetoacetamide on monomethyl acetoacetamide shows a loss in lightfastness.

EXAMPLE II

The following samples were prepared as in Example I containing diethylene glycol (DEG) as the polyol.

Sample A

Control 300 parts of a 62% DMDHEU/DEG reaction product
mixed with 100 parts of water

Sample B 300 parts of 62% DMDHEU/DEG reaction product
100 parts of 30% acetoacetamide solution
(i.e. 7.5% acetoacetamide)

Sample C 300 parts of 62% DMDHEU/DEG reaction product
44 parts of 70% monomethylacetoacetamide solution
56 parts of water
(i.e. 7.7% monomethylacetoacetamide)

Sample D 300 parts of 62% DMDHEU/DEG reaction product
36 parts of 80% dimethylacetoacetamide solution
64 parts of water
(i.e. 7.2% dimethylacetoacetamide)

Sample E 300 parts of 62% DMDHEU/DEG reaction product
60 parts of 80% dimethylacetoacetamide solution
40 parts of water
(i.e. 12% dimethylacetoacetamide)

| | | | | | | |
|---|---|---|---|---|---|---|
| pH | 3 | 3 | 3 | 3 | 3 | 7.1 |
| Formulation | 1 | 2 | 3 | 4 | 5 | 6 |
| PRODUCT: | | | | | | |
| Sample A | 10 | | | | | |
| Sample B | | 10 | | | | |
| Sample C | | | 10 | | | |
| Sample D | | | | 10 | | |
| Sample E | | | | | 10 | |
| Catalyst 531 | 2.5 | 2.5 | 2.5 | 2.5 | 2.5 | |
| Sulfanole 634 | 0.25 | 0.25 | 0.25 | 0.25 | 0.25 | 0.25 |
| % WET PICK-UP: | | | | | | |
| 100% Cotton 58.8% | | | | | | |
| 65/35 Poly/Cotton 63.3% | | | | | | |
| Dry 4 minutes @ 225° F. | | | | | | |
| Cure A: 90 seconds @ 320° F. | | | | | | |
| Cure B: 60 seconds @ 360° F. | | | | | | |
| TEST RESULTS: | | | | | | |
| Whiteness Meter | | | | | | |
| 100% Cotton | | | | | | |
| Cure A | 72.2 | 62.6 | 65.5 | 70.5 | 69.5 | 75.8 |
| Cure B | 67.7 | 53.1 | 60.9 | 69.4 | 70.1 | 74.8 |
| 65/35 Poly/cotton | | | | | | |
| Cure A | 99.4 | 81.5 | 89.6 | 96.8 | 96.5 | 99.9 |
| Cure B | 96.7 | 73.8 | 84.1 | 94.8 | 95.2 | 98.6 |

The results from a series of products made to compare the performance of glycolated DMDHEU resins mixed with various acetoacetamide derivatives. It can clearly be seen that fabrics treated with the dimethylacetoacetamide have significantly better whiteness ratings than fabrics treated with either monomethylacetoacetamide or acetoacetamide. Also resins prepared with acetoacetamide show uv fluorescence both in the product and on the treated fabric. Resins prepared using monomethylacetoacetamide after a period of storage time start to deposit needle like crystals. This tendency continues and would make such products unusable commercially.

EXAMPLE III

The acetoacetamide is a 30% solution referred to as AA, the monomethyl acetoacetamide is a 70% solution referred to as MAA and the dimethyl acetoacetamide is an 80% solution referred to as DMAA.

The following samples were prepared:

| | Formulation | | | | | | | | |
|---|---|---|---|---|---|---|---|---|---|
| | 1 | 2 | 3 | 4 | 5 | 6 | 7 | 8 | 9 |
| DMDHEU (54%) | 210 | 210 | 210 | 210 | 210 | 210 | 210 | 210 | |
| DEG | | 70 | | | | 70 | 70 | 70 | |
| AA | | | 100 | | | 100 | | | |
| MAA | | | | 44 | | | 44 | | |
| DMAA | | | | | 38 | | | 38 | |
| Water | 190 | 120 | 90 | 146 | 152 | 20 | 76 | 82 | |
| pH | 3.1 | 3.2 | 3.3 | 3.3 | 3.3 | 3.4 | 3.3 | 3.4 | 6.9 |
| PRODUCTS: | | | | | | | | | |
| Formulation 1 | 10 | | | | | | | | |
| Formulation 2 | | 10 | | | | | | | |
| Formulation 3 | | | 10 | | | | | | |
| Formulation 4 | | | | 10 | | | | | |
| Formulation 5 | | | | | 10 | | | | |
| Formulation 6 | | | | | | 10 | | | |
| Formulation 7 | | | | | | | 10 | | |
| Formulation 8 | | | | | | | | 10 | |
| Catalyst 531 | 2.5 | 2.5 | 2.5 | 2.5 | 2.5 | 2.5 | 2.5 | 2.5 | |
| Sulfanole 634 | 0.25 | 0.25 | 0.25 | 0.25 | 0.25 | 0.25 | 0.25 | 0.25 | 0.25 |
| % WET PICK-UP: | | | | | | | | | |
| 100% Cotton 63.6% | | | | | | | | | |
| 65/35 Poly/Cotton 65.5% | | | | | | | | | |
| Dry 4 minutes @ 225° F. | | | | | | | | | |
| Cure A: 90 seconds @ 320° F. | | | | | | | | | |
| Cure B: 60 seconds @ 360° F. | | | | | | | | | |
| TEST RESULTS: | | | | | | | | | |
| Whiteness Meter | | | | | | | | | |
| 100% Cotton | | | | | | | | | |
| Cure A | 73.34 | 72.16 | 70.53 | 70.81 | 71.95 | 72.12 | 71.77 | 73.72 | 74.09 |
| Cure B | 70.48 | 70.39 | 70.00 | 70.61 | 70.84 | 69.57 | 68.34 | 71.12 | 73.23 |
| 65/35 Poly/Cotton | | | | | | | | | |
| Cure A | 97.75 | 97.89 | 92.01 | 94.53 | 97.72 | 92.41 | 94.30 | 97.84 | 98.51 |
| Cure B | 96.95 | 95.61 | 86.26 | 92.92 | 92.94 | 88.79 | 89.21 | 93.02 | 97.45 |
| Average | 84.63 | 84.01 | 79.70 | 82.22 | 83.36 | 80.72 | 80.91 | 83.93 | 85.82 |

These results show that the addition of dimethyl acetoacetamide to either DMDHEU or DMDHEU blended with glycol has virtually no effect on the whiteness of the fabric. On the other hand, the addition of either acetoacetamide or monomethyl acetoacetamide causes a significant drop in whiteness. In addition the fabrics treated with resins containing acetoacetamide showed an unacceptable tendency to exhibit UV Fluorescence.

What is claimed is:

1. A composition for treating a textile fabric having reduced free formaldehyde levels both in the resin and in the finished treated fabric which comprises:

a resin comprising dimethyloldihydroxyethylene urea or an alkylated dimethyloldihydroxyethylene urea mixed with 2 to 60% by weight of a formaldehyde scavenger consisting essentially of dimethyl acetoacetamide wherein an effective amount of time is allowed for the free formaldehyde to react with the dimethyl acetoacetamide in the resin to reduce the level of free formaldehyde in the resin by at least 25%.

2. Composition of claim 1 wherein the level of free formaldehyde in the resin is reduced by at least 95%.

3. Composition of claim 1 further comprising a polyol, wherein the by weight ratio of amounts of dimethyloldihydroxyethylene urea or the alkylated dimethyloldihydroxyethylene urea: polyol is about 1–0.2-:1–6.

4. Composition of claim 3 comprising 5 to 40% by weight of dimethyl acetoacetamide.

5. Composition of claim 4 wherein the by weight ratio of amounts of dimethyloldihydroxyethylene urea or the alkylated dimethyloldihydroxyethylene urea: polyol is about 1–0.5:1–3.0.

6. Composition of claim 3 wherein the dimethyloldihydroxyethylene urea or the alkylated dimethyloldihydroxyethylene urea and the polyol are reacted.

7. Composition of claim 3 wherein the polyol is selected from the group consisting of ethylene glycol, diethylene glycol, propylene glycols, butylene glycols and glycerine and their mixtures.

8. Process for treating textile fabrics comprising impregnating a textile fabric with the composition of any of claims 1, 3, 5, 6 or 7 and a catalyst and drying the impregnated textile fabric.

9. Process of claim 8 further comprising curing the treated textile fabric.

10. Textile fabric prepared by the process of claim 8.

11. Textile fabric prepared by the process of claim 9.

* * * * *